United States Patent [19]

Lade

[11] Patent Number: 4,565,048

[45] Date of Patent: Jan. 21, 1986

[54] CONVERTIBLE-FORMAT PACKAGING MACHINE

[75] Inventor: Günther Lade, Winnenden-Birkmannsweiler, Fed. Rep. of Germany

[73] Assignee: Robert Bosch GmbH, Stuttgart, Fed. Rep. of Germany

[21] Appl. No.: 691,771

[22] Filed: Jan. 16, 1985

[30] Foreign Application Priority Data

Mar. 23, 1984 [DE] Fed. Rep. of Germany ..... 3410685

[51] Int. Cl.[4] ..... B65B 59/00

[52] U.S. Cl. ..... 53/201; 318/601; 493/34; 493/476; 493/478

[58] Field of Search ..... 53/201, 396; 493/34, 493/30, 478, 475, 476; 318/652, 562, 565, 567, 569, 601

[56] References Cited

U.S. PATENT DOCUMENTS

| | | | |
|---|---|---|---|
| 3,323,285 | 6/1967 | Hagedorn | 53/374 |
| 3,325,977 | 6/1967 | Kirsten | 53/250 |
| 3,373,665 | 3/1968 | Bivans | 493/181 |
| 3,509,681 | 5/1970 | Sass | 53/473 |
| 3,514,922 | 6/1970 | Cravens et al. | 53/201 X |
| 3,940,675 | 2/1976 | Schroeder | 318/601 X |
| 4,216,415 | 8/1980 | Shimonou et al. | 318/601 X |
| 4,264,848 | 4/1981 | Jansen | 318/565 |
| 4,323,098 | 4/1982 | Suzuki et al. | 493/34 X |
| 4,371,365 | 2/1983 | Shingo | 493/34 X |
| 4,398,837 | 8/1983 | Torii et al. | 318/565 X |
| 4,485,338 | 11/1984 | Matsuura et al. | 318/569 |

OTHER PUBLICATIONS

U.S. Ser. No. 653,624, 09/24/84, Denk et al.

*Primary Examiner*—James F. Coan
*Attorney, Agent, or Firm*—Edwin E. Greigg

[57] ABSTRACT

It is proposed to adjust components, tools and devices of a packaging machine to various formats in accordance with the products to be packaged and packaging material to be used. To assure that the operator will approach the correct conversion point when adjusting the individual conversion points in accordance with a program of a data-processing control unit, the various conversion points have code carriers with a code identifying the particular conversion point. The control unit does not emit an adjusting signal unitl the operator has connected a code reader with the code carrier the code of which agrees with the conversion point displayed at the control unit.

8 Claims, 6 Drawing Figures

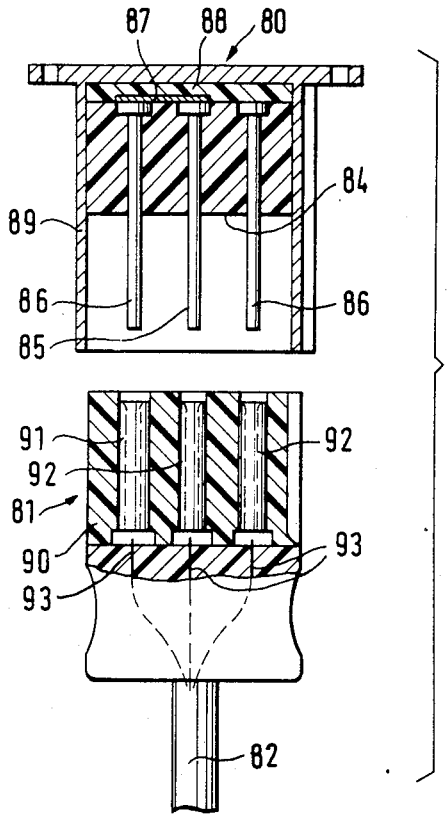
FIG. 4
FIG. 5
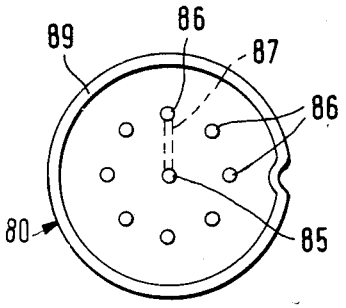
FIG. 6
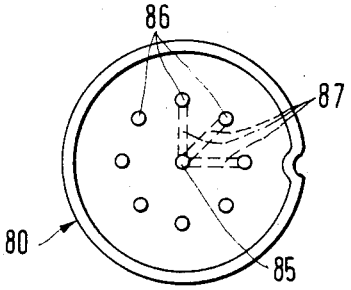

CONVERTIBLE-FORMAT PACKAGING MACHINE

BACKGROUND OF THE INVENTION

The invention is based on a packaging machine as generally defined hereinafter. In a packaging machine of this kind, proposed in U.S. patent application Ser. No. 653,624 also assigned to the assignee of this application, a control unit computer directs the adsjustment of the various convertible components of the packaging machine when a change in the format is to be made. In particular, the computer controls a motor-driven tool in accordance with stored adjustment values such that the components to be adjusted are each put into a position that matches the format to be used. For adjusting the components, an operator who guides the mobile tool is instructed by the computer via a monitor to approach specific conversion points, which are provided with an identifying number, and couple the mobile tool to the adjusting screw of the particular conversion point. In a packaging machine embodied in accordance with this proposal, there is the danger than an inexperienced operator may mistakenly approach the wrong conversion point, thereby moving its adjustable component to the wrong position. When the machine is later put into operation, this may result not only in the destruction of the packaging material being used, but in breakage and other damage to parts of the machine as well.

OBJECT AND SUMMARY OF THE INVENTION

The packaging machine according to the present invention has the advantage that a component is adjusted only if the computer has recognized that the conversion point approached by the operator is correct. Disposing the code carrier directly on the conversion point also has the advantage that mistaking one conversion point for another is precluded.

Various advantageous embodiments of the packaging machine according to the invention are possible. A particularly advantageous provision is that the code carrier is encoded in binary form. In order to provide complete assurance that the operator has approached the correct conversion point, the code carrier and the code reader are embodied such that they can be joined to one another by a plug connection.

The invention will be better understood and further objects and advantages thereof will become more apparent from the ensuing detailed description of a preferred embodiment taken in conjunction with the drawings.

BRIEF DESCRIPTION OF THE DRAWINGS

FIG. 4 shows a code carrier and a code reader in longitudinal section; and

FIGS. 5 and 6 show the code carrier in plan view.

DESCRIPTION OF THE PREFERRED EMBODIMENTS

Figure 1:
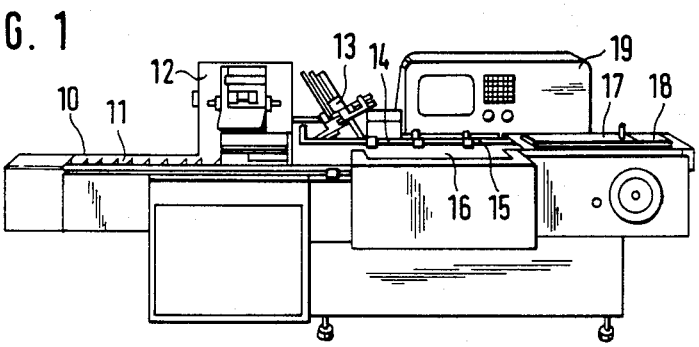
FIG. 1 shows a cartoning machine in simplified form in a generally elevational view.

A cartoning machine 10, which is shown as an example of a packaging machine, has a product delivery device 11, a brochure folding apparatus 12, a folding box magazine 13, a folding box transporting device 14 with driver prongs 15, a product insertion device 16, a folding and closing device 17, an outlet 18 and a control unit 19. The devices 11–18 of the cartoning machine 10 have tools and components that can be adjusted within a predetermined range, so that the machine can be adjusted or converted for packaging objects of various dimensions in foldable boxes of the appropriate length, width and height.

Figure 2:
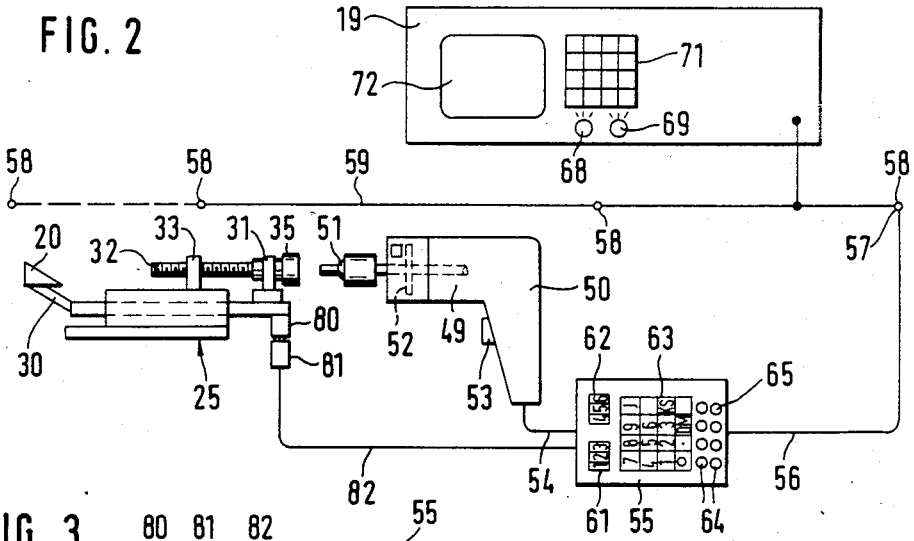
FIG. 2 shows a conversion point and a mobile tool with a control device in simplified form, seen in a front view.
Figure 3:
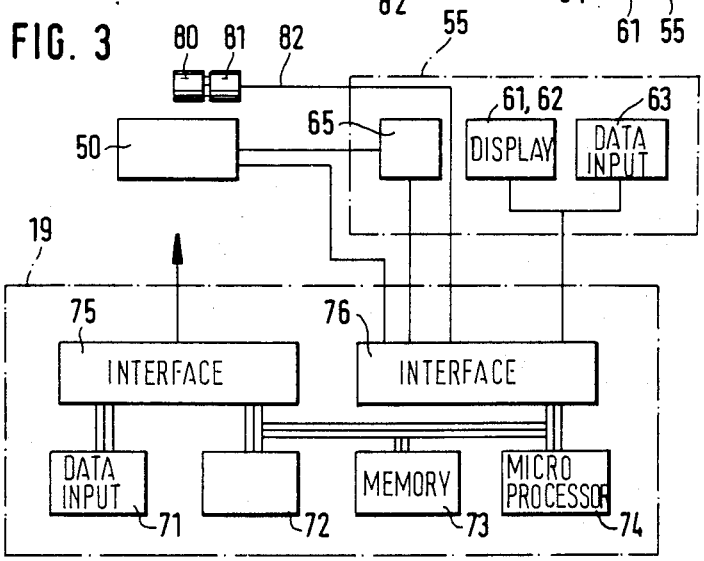
FIG. 3 is a block circuit diagram of a control means for the mobile drive.

In the following discussion, only one folding rail 20 of the folding and closing device 17 will be shown (FIG. 2) and explained, as an example illustrating the convertibility of the various devices 11–18. In accordance with the length of the foldable boxes to be used, the folding rail must be positioned in a predetermined position with respect both to stationary parts of the machine and to the delivery device 17. To this end, the folding rail 20 is secured on a displaceable rail 30 of a stationary sliding guide 25. To adjust the rail 30 and keep it in a predetermined position, an adjusting screw 32 is supported in a bearing block 31 on the rail 30 such that it is rotatable but not axially displaceable. With its threaded portion the screw 32 engages a threaded bore of an eye 33 on the sliding guide 25. The adjusting screw 32 has a head 35 to which a coupling piece 51 of a mobile, hand-guided rotating drive unit 50 can be positively connected.

The other devices 11–18 and their components which are adjustable to the various product and foldable box formats involved are likewise equipped with the same or similar sliding guides 25; with adjustment in only a single dimension, a single sliding guide is used, while with two-dimensional adjustment, two sliding guides coupled at an angle are used.

The mobile rotating drive unit 50, which is to be guided by an operator, is used to adjust the sliding guides. It includes an electric motor 49 with a reversible direction of rotation, a position transducer 52 and a finger-actuated pushbutton contact 53. To supply electrical energy and to transmit the electrical signals of the position transducer 52, the drive unit 50 is connected to a switching unit 55 by a multi-conductor cable 54. The switching device can be connected by means of a cable 56 and a plug 57 to one of a plurality of connections 58 of a distributor or perimeter line 59, which leads to the central control unit 19.

Like the mobile rotating drive unit 50, the switching unit 55, which may also be integrated into the drive unit 50, is not stationary; it can instead be moved by the operator, together with the mobile drive unit 50, to the particular conversion point of the machine to be approached, so as to be able there to perform and monitor a conversion. The switching unit 55 has a lighted display 61 for the identifying number of the conversion point to be approached; a lighted display 62 for the position; an input keyboard 63 with preselected keys for inputting, cancelling and correcting numbers of the conversion points and positions; and a plurality of monitor lights 64.

Like the switching unit 55, the stationary control unit 19 also has an input keyboard 71 with the same functions as the input keyboard 63. Additionally, the control unit 19 has two operating mode switches 68, 69. A monitor 72 is also disposed on the control unit 19 where it is visible; on this monitor, information and instructions are displayed to the operator under program control. The control unit 19 also has a memory 73 for storing the data of the various conversion points of the machine for a plurality of formats, each point being provided with identifying numbers, and for storing programs for the sequence of the conversions. The data and signals stored and input are processed by a microprocessor 74 and transmitted in the form of signals. To this end, the keyboard 71, the monitor 72, the memory 73, the microprocessor 74, the switching unit 55 and the mobile drive unit 50 are interconnected via two interfaces 75, 76. Via the interface 75, signals relating to various positions of movable machine components and tools can also be fed into the control system.

To inquire whether the operator has approached the particular conversion point called up by the computer of the control unit 19 and displayed in both the monitor 72 and the lighted display 61 of the switching unit 55, each conversion point has a code carrier 80, with each conversion point having its own code. The various codes can be called up by the computer of the control unit 19 via a code reader 81, which can be temporarily connected to one of the code carriers 80 at a time. The code carriers 80 are each fixedly disposed near the adjusting screw 32 of the associated conversion point. Contrarily, like the mobile rotating drive unit 50 and the switching unit 55, the code reader 81 is movable. It is joined to the switching unit 55 and to the interface 76 of the control unit 19 via a flexible cable 82.

The code carrier 80 and the code reader 81 are preferably designed as interlocking plugs, so that a temporarily firm connection is possible. Other code carriers are also possible, however, such as slash marking codes which are scanned by a code reader passed over them. The code carriers 80 have a body 84 of insulating material, in which a plurality of prongs 85, 86 are inserted in an axially parallel manner. The arrangement of the prongs 85, 86 is such that, by way of example, the other prongs 86 are disposed spaced uniformly apart in a circle around one central prong 85. Depending on the code that has been set, the ends of the prongs 85, 86 seated in the body 84 are interconnected by bridges 87 in accordance with a pattern that changes for each code carrier 80; for instance, the middle prong 85 may be connected with the upper prong 86 (FIG. 5), or the middle prong 85 may be connected with three outer prongs 86 (FIG. 6), so that when electric current is supplied to the middle prong 85 the prongs 86 connected with it, and only those prongs 86, are also subjected to electric current. Depending on the disposition of one or more bridges 87, many codes, in a binary pattern, can be produced in the various code carriers 80. It need not necessarily be the middle prong 85 that is always subjected to electric current. The insulating body 84 is covered with an insulating plate 88 on the side having the prongs 85, 86 and the bridges 87, and it is seated in a housing 89 which is open on one side and which also surrounds the other ends of the prongs 85, 86 that protrude beyond the body 84.

In a two-piece body 90 of insulating material, the code reader 81 that can be plugged together with the code carrier 80 has sockets 91, 92 arranged in the same pattern as the prongs 85, 86. These sockets 91, 92 are electrically connected to lead wires 93 of the multi-conductor cable 82. After the code reader 81 and one of the code carriers 80 are plugged into one another and electric current is supplied to the middle socket 92, then the middle prong 85 as well as one of more prongs 86, depending on the arrangement of bridges 87, and the outer sockets 91 in contact with this prong or prongs 86 are subjected to electric current, causing one or another of the lead wires 93 of the cable 82 to send electrical signals back to the interface 76 of the control unit 19 in accordance with the set code of the particular code carrier 80.

Adjusting the machine to a particular format is accomplished as follows:

With the machine stopped, the operator first sets the switch 68 to "formatting" and the switch 69 to "format data callup"; then, via the keyboard 71 on the control unit 19 or via the keyboard 63 on the switching unit 55, he feeds the identifying number associated with the selected format into the control unit 19. The program corresponding to the input identifying number and stored in the memory 73 is then called up by the microprocessor 74. First the input format identifying number is displayed on the monitor 72. Then the number of the first conversion point to be approached is displayed numerically on the monitor 72, while its name is displayed there in letters. The number of the conversion point to be approached is similarly displayed in the lighted display 61 of the switching unit 55. With the mobile drive unit 50, the switching unit 55 and the code reader 81, the operator now approaches the indicated conversion point, plugs the code reader 81 into the code carrier 80 of the associated conversion point, and couples the coupling piece 51 of the drive unit 50 to the head 35 of the adjusting screw 32 of that conversion point. By depressing the pushbutton contact 53, the operator indicates readiness for conversion to the control unit 19. Under the control of the program that has been input and called up, and if the conversion point displayed matches the conversion point approached, the control unit 19 thereupon directs the mobile drive unit 50 first into counterclockwise operation, so that the associated rail 30 is first moved into its reference zero position against a stop. After the zero position has been attained, then because of the abruptly rising current the rotational direction of the drive unit 50 is reversed by the computer, causing the rail 30 to be moved toward the new position. When the predetermined position is attained, the control unit 19 shuts the drive unit 50 off again. By pressing the signoff key of the keyboard 63 of the switching unit 55, the operator informs the control unit 19 that the conversion just performed has been completed. Thereupon the number and name of the next conversion point to be approached appear on the monitor 72. The number of the next conversion point likewise appears in the lighted display 61 of the switching unit 55. After the code reader 81 is unplugged from the code carrier 80 of the conversion point that has just been completed, and after uncoupling the drive unit 50, the operator takes the mobile drive unit 50, the switching device 55 and the code reader 81 and seeks out the newly indicated conversion point and proceeds in the same manner as described above. The preprogrammed sequence of operations is continued in the same manner until all the conversion points have been adjusted to the new format. Should the operator approach some other conversion point not displayed on the monitor by the computer and connect the code reader to the wrong code carrier 80 there, the computer will compare the key-input code with the code coupled with the existing adjusting signal and will withhold the adjusting signal. The operator must then check what he has done incorrectly.

In the above-described example, the components of the machine are automatically moved, under the control of the computer of the control unit 19, into the position matching the format after the operator has connected the code reader 81 with the associated code carrier 80 and has coupled the drive unit 50 with the adjusting screw 32 of the associated conversion point. Since packaging machines also have conversion points that because of a lack of space are inaccessible with the mobile drive unit, these conversion points must be adjusted by hand under some circumstances, using a small tool. In order to be able to bring the component to be adjusted into the position adapted to the selected format, a scale is disposed on the sliding guides of these conversion points, on which the operator can read off the position of the particular component. To prevent the operator from mistaking these conversion points for one another as well, code carriers 80 are again provided at these conversion points. Before the operator turns the adjusting screw 32 of the conversion point he has approached, he connects the code reader 81 to the code carrier 80 disposed at this conversion point. If the number of the conversion point displayed in the monitor 72 and in the switching unit 55 agrees with the number of the conversion point scanned by the code reader 81, the operator is informed that he is at the correct conversion point by the lighting up of the monitor lights 65 on the switching unit 55. In accordance with the positional value also displayed on the monitor and in the lighted display 62 of the switching unit 55, the operator moves the appropriate component of the conversion point into the indicated position, using a tool if needed. After completing the adjustment, the operator unplugs the code reader 81 from the associated code carrier 80 again.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A packaging machine having devices which are adjustable in accordance with a format for delivering the products to be packaged and for transporting, shaping and handling the packaging material, further including a plurality of conversion points in said devices for adjusting the components thereof in accordance with the size and shape of the products and packaging material, and a control unit in which adjustment values for individual conversion points for a given format are stored and can be data processed in accordance with a program, characterized in that one of a plurality of code carriers arranged to identify the particular conversion point is associated with each of said individual conversion points, a movable code reader connected with said control unit connectable to at least one of said code carriers, and further that said control unit generates an adjustment signal only when said movable code reader agrees with the code which is coupled with the adjustment value made available at that time by said control unit.

2. A packaging machine as defined by claim 1, characterized in that said code carrier is binary encoded.

3. A packaging machine as defined by claim 2, characterized in that said code carriers have electrically conductive, alternatively disposed linkages.

4. A packaging machine as defined by claim 3, characterized in that said code carriers and said code reader are embodied such that they interlock in the manner of a plug means.

5. A packaging machine as defined by claim 1, characterized in that said packaging machine is further provided with a motor-drive mobile tool and a switching unit, said code reader being arranged to be connected with said switching unit and said control unit via a flexible cable.

6. A packaging machine as defined by claim 2, characterized in that said packaging machine is further provided with a motor-drive mobile tool and a switching unit, said code reader being arranged to be connected with said switching unit and said control unit via a flexible cable.

7. A packaging machine as defined by claim 3, characterized in that said packaging machine is further provided with a motor-drive mobile tool and a switching unit, said code reader being arranged to be connected with said switching unit and said control unit via a flexible cable.

8. A packaging machine as defined by claim 4, characterized in that said packaging machine is further provided with a motor-drive mobile tool and a switching unit, said code reader being arranged to be conenected with said switching unit and said control unit via a flexible cable.

* * * * *